US006340178B1

(12) United States Patent
Nakanishi et al.

(10) Patent No.: US 6,340,178 B1
(45) Date of Patent: Jan. 22, 2002

(54) PRINTABLE KIT FOR MAKING AN ORIGINAL HOLDER FOR FLAT OBJECTS

(75) Inventors: Noriko Nakanishi; Hisayo Yamamoto; Keisuke Niwa; Miho Yokota; Yusuke Nakagawa; Takao Tsubouchi, all of Nagoya (JP)

(73) Assignee: Hisago Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/418,493

(22) Filed: Oct. 15, 1999

(30) Foreign Application Priority Data

Feb. 10, 1999 (JP) ..... 11-033301
Jun. 2, 1999 (JP) ..... 11-155645

(51) Int. Cl.[7] ..... B42D 1/00

(52) U.S. Cl. ..... 281/45; 281/15.1; 281/21.7; 281/29; 281/36; 281/38; 412/1; 412/4; 412/6; 412/7; 412/43; 229/67.1; 229/71; 229/72; 229/84; 229/92.3; 229/300

(58) Field of Search ..... 281/15.1, 21.1, 281/29, 36, 38, 45; 412/1, 4, 6, 7, 43; 229/67.1, 72, 84, 71, 92.3, 300

(56) References Cited

U.S. PATENT DOCUMENTS 2,289,949 A * 7/1942 Wisdom ..... 281/29
4,852,740 A 8/1989 Sellar et al.
5,290,118 A 3/1994 Ozeki
5,579,908 A * 12/1996 Johnson ..... 281/45
5,667,322 A * 9/1997 Mucznik ..... 281/29
5,683,111 A 11/1997 Bass et al.
6,082,612 A * 7/2000 Black ..... 206/308.3

FOREIGN PATENT DOCUMENTS

JP 10-297153 11/1998
JP 11-91279 4/1999

* cited by examiner

*Primary Examiner*—Willmon Fridie, Jr.
*Assistant Examiner*—Marc T. Henderson
(74) *Attorney, Agent, or Firm*—Wenderoth, Lind & Ponack, L.L.P.

(57) ABSTRACT

A kit for making an original holder is disclosed. In the kit, a holder 10 of A4 size with a paper fastener 7 is divided into two and provided as two members 11 and 12. The member 11, consisting of a front panel 1 isolated from other portions of the holder cover, is a substantially flat paper sheet and generally rectangular in standardized lengthwise A4 size which is adapted to be passed through common personal printers easily. The member 12 consists of the rest of the holder cover and a paper fastener 7. The rest of the cover is made with a single paper sheet in which a back panel 2, a spine panel 3, a pleat 4 and a joint portion 5 are defined by folding the sheet, and the paper fastener 7 is secured on the pleat 4. A double-coated adhesive tape 6 is adhesively bonded on the outside surface of the joint portion 5 along a line a—a. Upon making the holder 10 with this kit, the member 11 is fed through a printer and any desired designs are printed thereon. Then, the members 11 and 12 are overlapped with the lines a—a and a'—a' matched up and secured together with the adhesive tape 6.

8 Claims, 17 Drawing Sheets

- Prior Art -

- Prior Art -

PRINTABLE KIT FOR MAKING AN ORIGINAL HOLDER FOR FLAT OBJECTS

BACKGROUND OF THE INVENTION

1. Field of the Invention

This invention relates to holders for flat objects such as papers and/or computer disks. More particularly, this invention is directed to kits for easily making original holders by directly printing on covers with common personal printers, such as laser or ink jet printers.

2. Description of the Prior Art

Various types of holders for holding flat objects have previously been proposed. To have a better understanding of the invention, some typical constructions of conventional holders will first be described.

One of the principal types of such holders is generally known as a "Flat-type holder". One example thereof is disclosed in Japanese Utility Model Publication No.93-82583, which is incorporated herein by reference. A holder 100 of this type, as shown in FIG. 16, comprises a cover 101 and a fastener 102. The cover 101 is made with a single paper sheet, and consists essentially of a front panel 1, a back panel 2, a spine panel 3 and a pleat 4 defined by folding the sheet on its folding lines b—b, c—c, d—d and e—e as shown in FIG. 16. A folding line a—a is a guiding line to open the front panel. The fastener 102 is secured on the pleat 4.

In this construction, however, since the entire cover 101 is made with a single sheet, the sheet itself inevitably becomes bigger. This structure causes difficulties in direct printing on the holder cover by small and low-cost popular personal printers, such as laser and ink jet printers, without encountering limited feed size problems, jamming problems, or distorted printing problems.

Another type of such holders is generally known as a "pocket-type holder". A holder 200 of this type as shown in FIG. 17, comprises a cover 201 and a pocket 202. The cover 201 is made with a single paper sheet too, and consists essentially of a front panel 1 and a back panel 2 defined by folding the sheet on its folding line g—g located in the middle of the sheet. Typically, the pocket 202 is formed on the inside surface of the back panel 2 with pocket flaps 203 and 204.

In this construction, however, since the entire cover 201 is made with a single sheet (usually the pocket flaps 203 and 204 are also included), the sheet itself inevitably becomes bigger. This construction makes it difficult for end-users to print directly on the cover by common personal printers because of size, shapes and other considerations. Furthermore, these holders are normally provided with their pocket flaps 203 and 204 having been firmly fixed on the back panel to form the pocket 202, which makes it almost impossible to feed the sheet through the printers.

As a result, if end-users want to put original designs on the covers of above-mentioned holders, they usually either draw or write by hand directly on the covers, or else print the design on separate pieces of papers or labels first and then glue them on the covers. Consequently, making original design holders with a good appearance is difficult for most end-users.

Additionally, computer disks, such as Floppy Disks (FD), Magnetic Optical Disks (MO) and Compact Disks (CD) including CD-ROMs have become so popular that the demand for cost effective cases for them has increased. These disks are sometimes desired to be stored with related documents for convenience. Although some types of holders for them have been proposed, none of them was well designed to store these disks together with documents.

The present invention is directed to overcoming the problems as set forth above.

SUMMARY OF THE INVENTION

Therefore, it is a principal object of the present invention to provide a kit for making an original designed holder easily by enabling end-users to directly print on covers with common personal printers.

These and other objects of the present invention are accomplished by a kit for making a holder comprising a cover consisting of front and back panels and a means for holding flat objects such as papers and disks. At least a member including the front panel of the cover is provided as a printable single sheet in a substantially flat and generally rectangular form. The rectangular member including the front panel has a standard width and/or length.

According to the above-described construction, the holder cover is divided into at least two members provided as relatively small sheets in the kit. Thus, the provided member including the front panel of the cover can be a printable single sheet in substantially flat and generally rectangular form, and would not cause size and jamming problems even when small and low-cost printers are used to print thereon. Furthermore, since at least one of the width and the length of this member follows standard sizes, it can be easily fed into those printers essentially designed for operation on standard size papers in rectangular form. As a result, end-users can print directly at least on the front panel with common personal printers, and can make a holder of original design by assembling it after printing.

BRIEF DESCRIPTION OF THE DRAWINGS

The above and other objects and advantages of this invention will be more readily apparent from a reading of the following description taken in conjunction with the following drawings in which.

Figure 1:
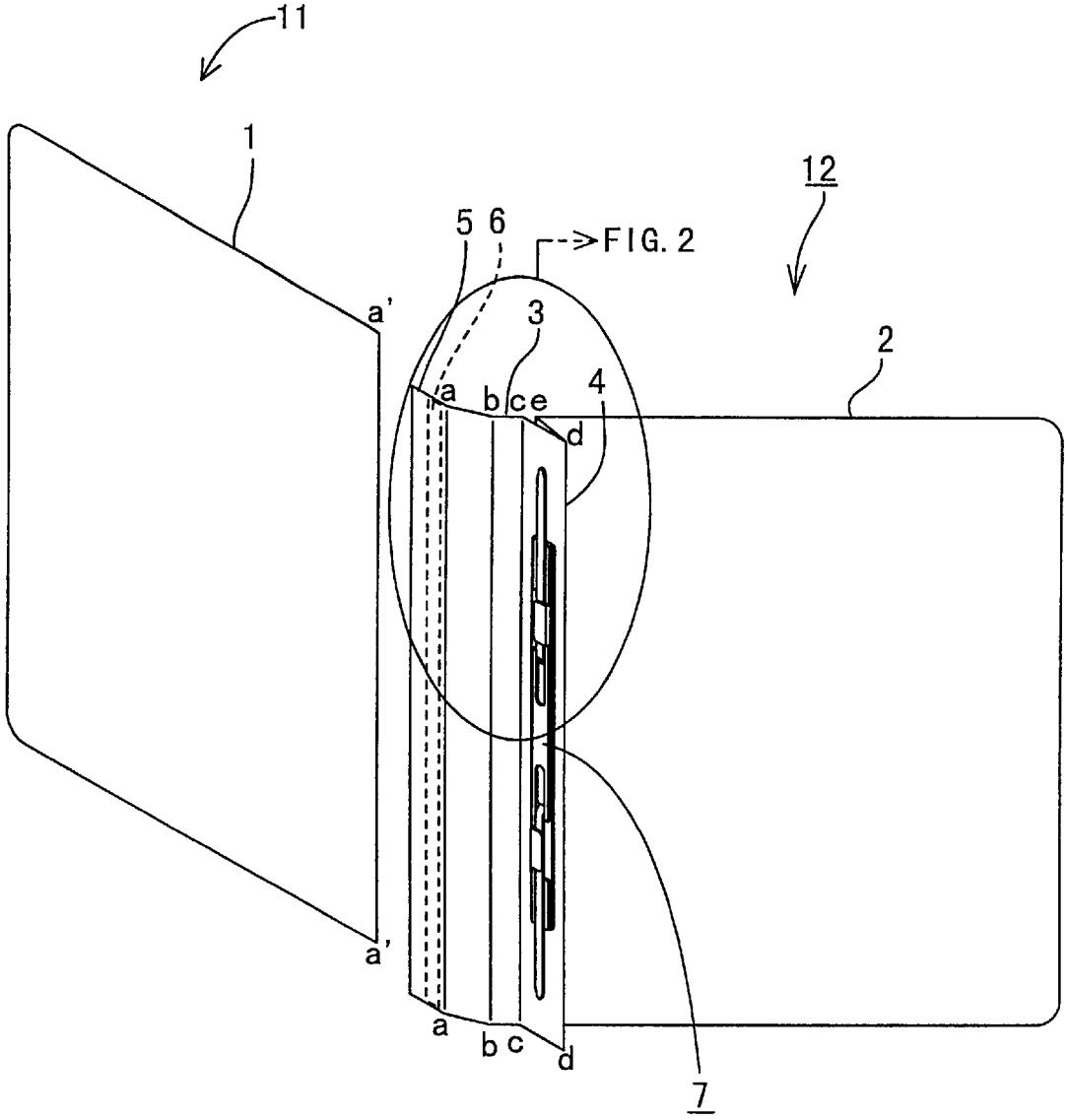
FIG. 1 is a perspective view of a kit of a first embodiment in accordance with the present invention.

Repeat use of reference characters in the present specification and drawings is intended to represent same or analogous features for the sake of clarity.

DESCRIPTION OF THE PREFERRED EMBODIMENTS

<First Embodiment>

Figure 2:
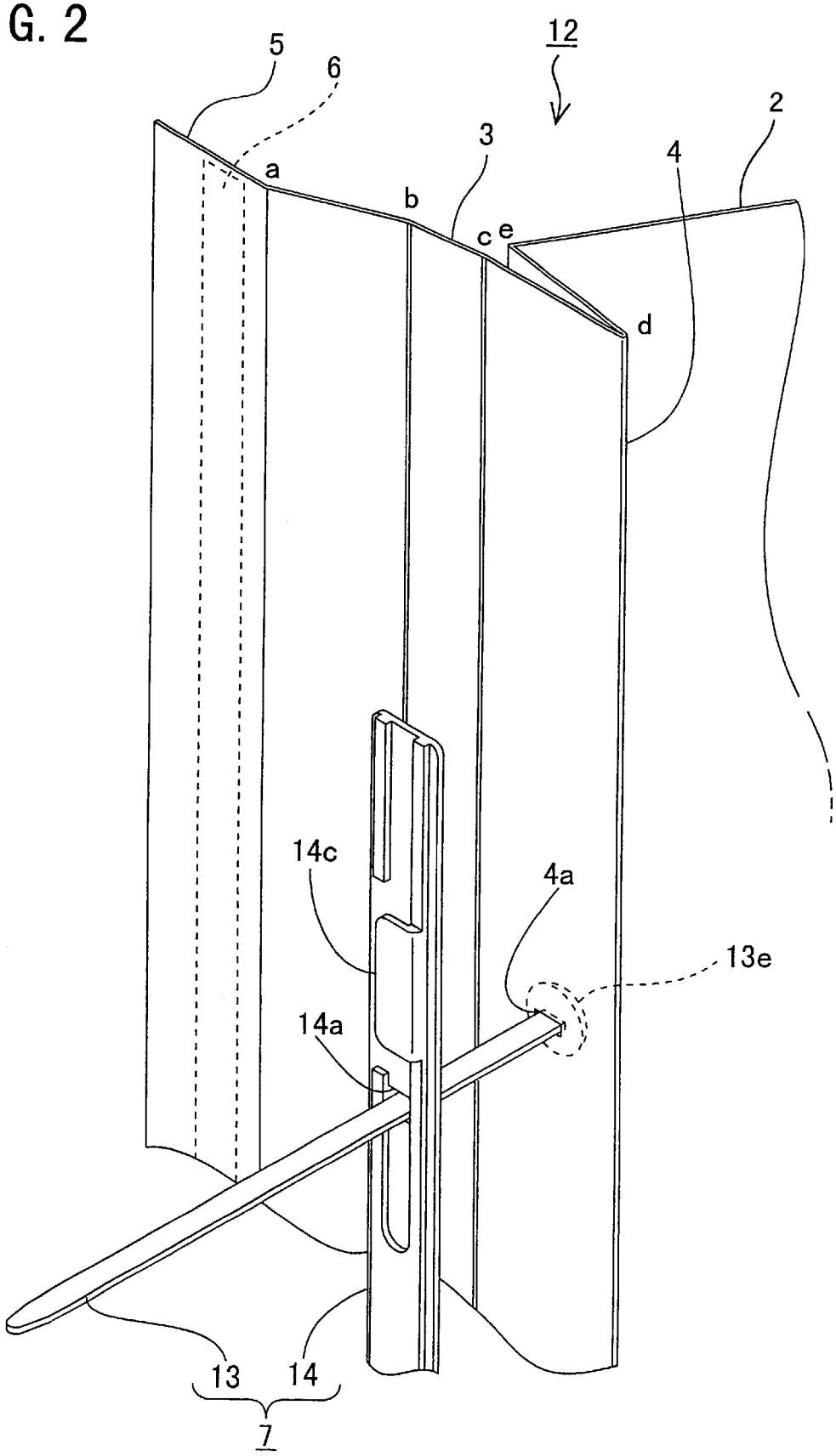
FIG. 2 is an enlarged perspective view showing a portion around a fastener of FIG. 1 bounded by a circle.
Figure 3:
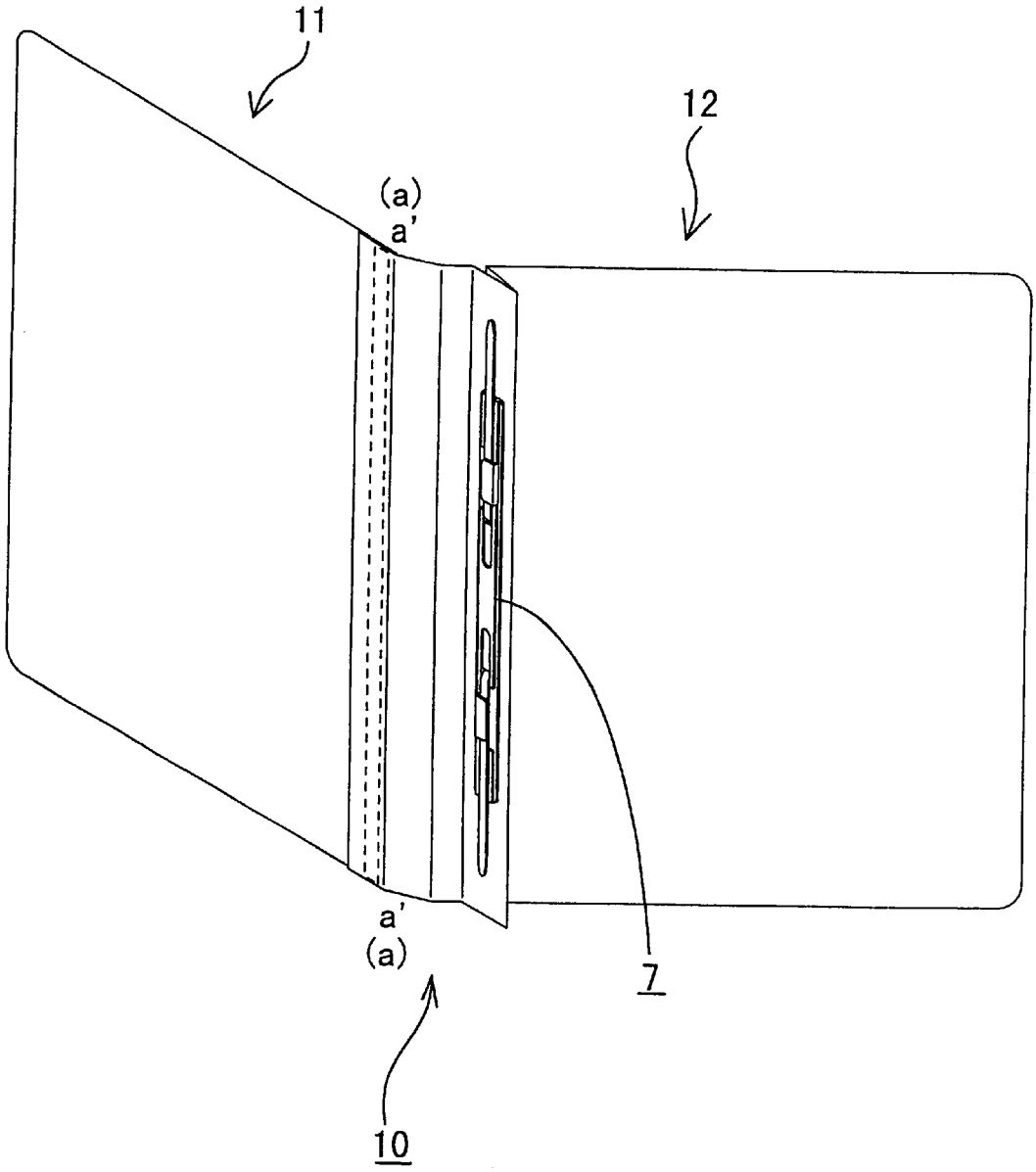
FIG. 3 is a perspective view of a document holder assembled with the kit of the first embodiment.

A first embodiment of the present invention will be described with reference to FIGS. 1 through 3. FIG. 1 schematically shows a kit for making a holder 10 of A4 size with a paper fastener 7. The kit comprises two members 11 and 12. The member 11 is a paper sheet that is substantially flat and consists of a front panel 1 isolated from other portions of the holder cover. Although two of the corners may be slightly rounded, the member 11 substantially follows standardized lengthwise A4 size. The member 12 comprises the rest of the holder cover made with a single paper sheet. The paper is folded on a line e—e to define a back panel 2, lines d—d and c—c to define a pleat 4, line b—b to define a spine panel 3 and line a—a to define a joint portion 5. A double-coated adhesive tape 6 is adhesively bonded on its outside surface along the line a—a. The member 12 further comprises a fastener 7 consisting of two strips 13 and a bar 14, made of polypropylene, attached thereto in the manner shown in FIG. 2 as a holding part for holding flat objects. The strips 13 are threaded through apertures 4*a* formed on the pleat 4 from its back panel side, with expanding ends 13*e* engaging with edges of the apertures 4*a*. The strips 13 are further threaded through apertures 14*a* on the bar 14, upon which the strips 13 are bent over and then pushed under engaging claw 14*c* on the bar 14, to fix the fastener 7 onto the pleat 4.

Upon making an original holder 10 with above-described kit, the member 11 is fed through a printer and any desired designs are printed thereon. After printing, the members 11 and 12 are overlapped with a side edge a'—a' of the member 11 matching with the line a—a at the joint portion of the member 12, and are secured by the adhesive tape 6. The holder 10 assembled with this kit is shown in FIG. 3. Documents such as plain papers to be held fast in this holder 10 are punched to provide apertures along their long side. Releasing the strips 13 from the engaging claw 14*c*, the bar 14 is detached from the pleat 4. Then, the strips 13, still fixed on the pleat 4, are threaded through the apertures of the papers. In order to prevent the strips 13 from pointing randomly or "straggling", and to prevent the papers from slipping out, the bar 14 is threaded onto the strips 13 again before the strips 13 are flattened. They are then pushed under the engaging claw 14*c* to hold them.

According to the first embodiment, a kit is provided in which the holder cover is divided into two members 11 and 12. Since the member 11 consisting of the front panel 1 follows A4 size, it is much easier to directly print on it than on the front panel 1 of the conventional holder 100. Furthermore, even a small printer whose feeding width is limited within lengthwise A4 width, which also is the most popular type of printers for personal use because of its low cost, can be used in this operation. In order to print directly on the member 11, the thickness of the sheet used as the member 11 is limited depending on the performance of the printer. In other words, a sheet which is too thick or rigid to be fed through the printers can not be used as the member 11. However, a thicker sheet can be used for the member 12 to provide enough strength and rigidity to the holder 10. The holder 10 can be assembled easily just by securing the member 11 to the member 12 with the double coated adhesive tape 6 on the member 12.

<Second Embodiment>

Figure 4:
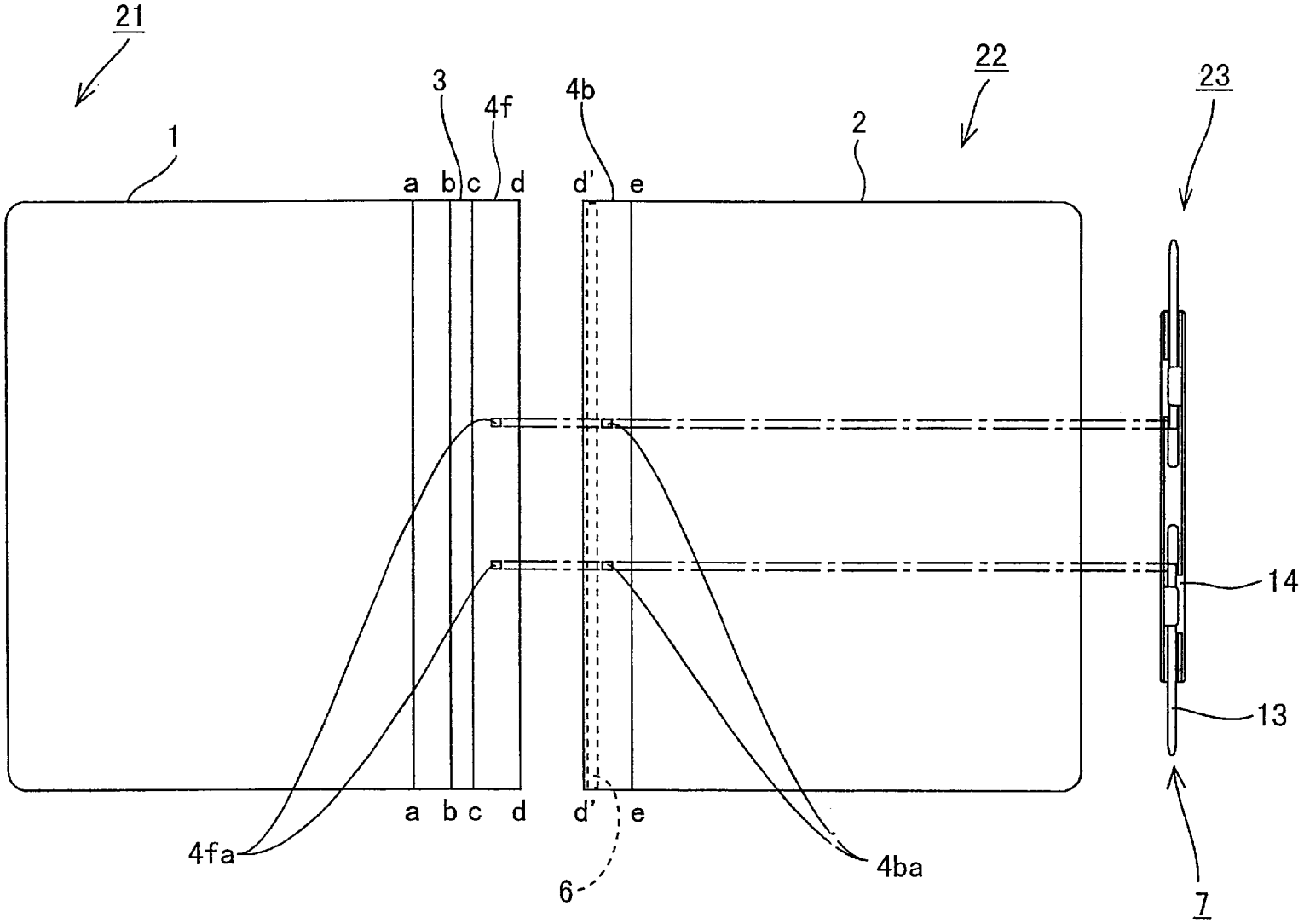
FIG. 4 is a plan view of a kit of a second embodiment in accordance with the present invention.
Figure 5:
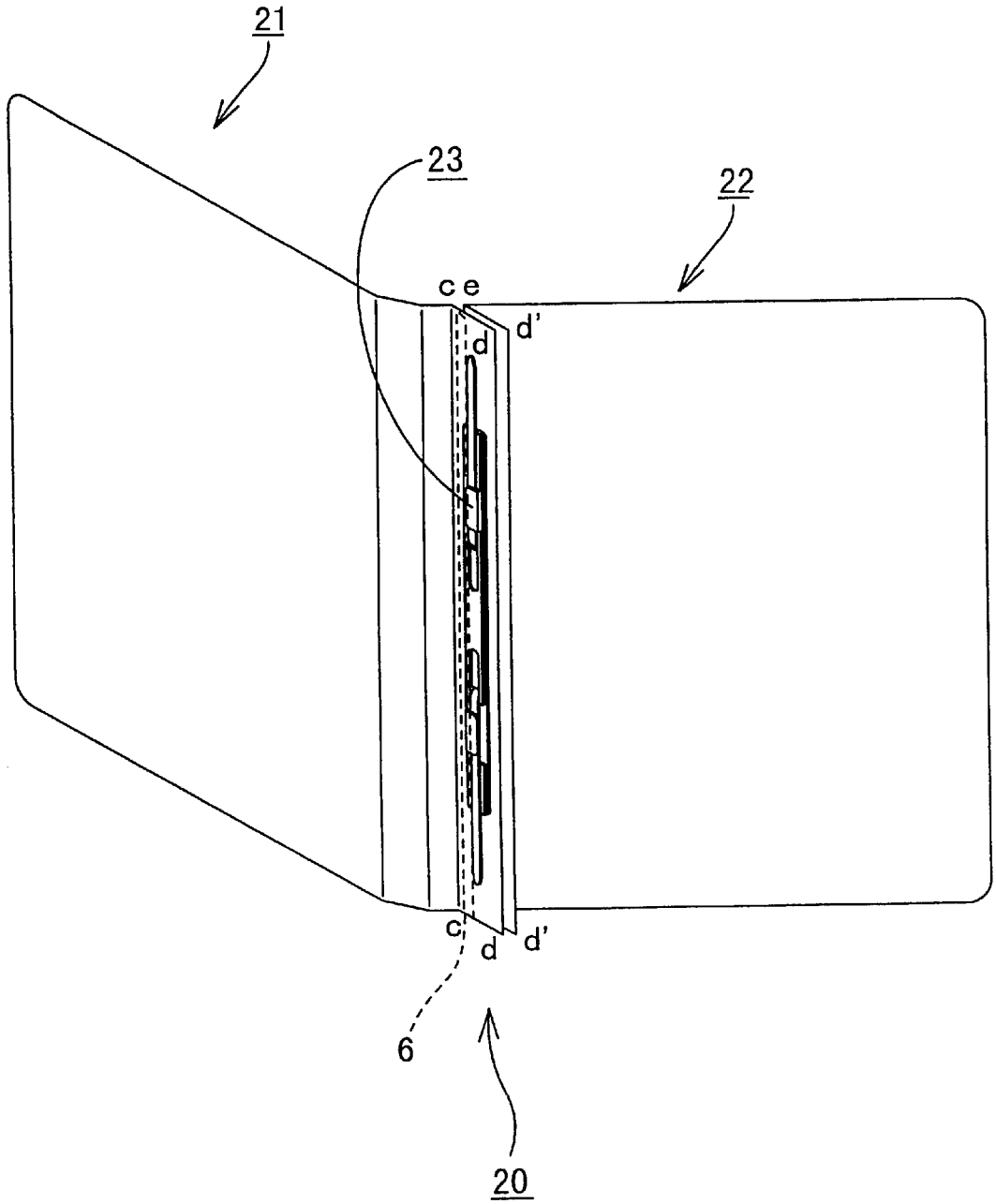
FIG. 5 is a perspective view of a document holder assembled with the kit of the second embodiment.
Figure 16:
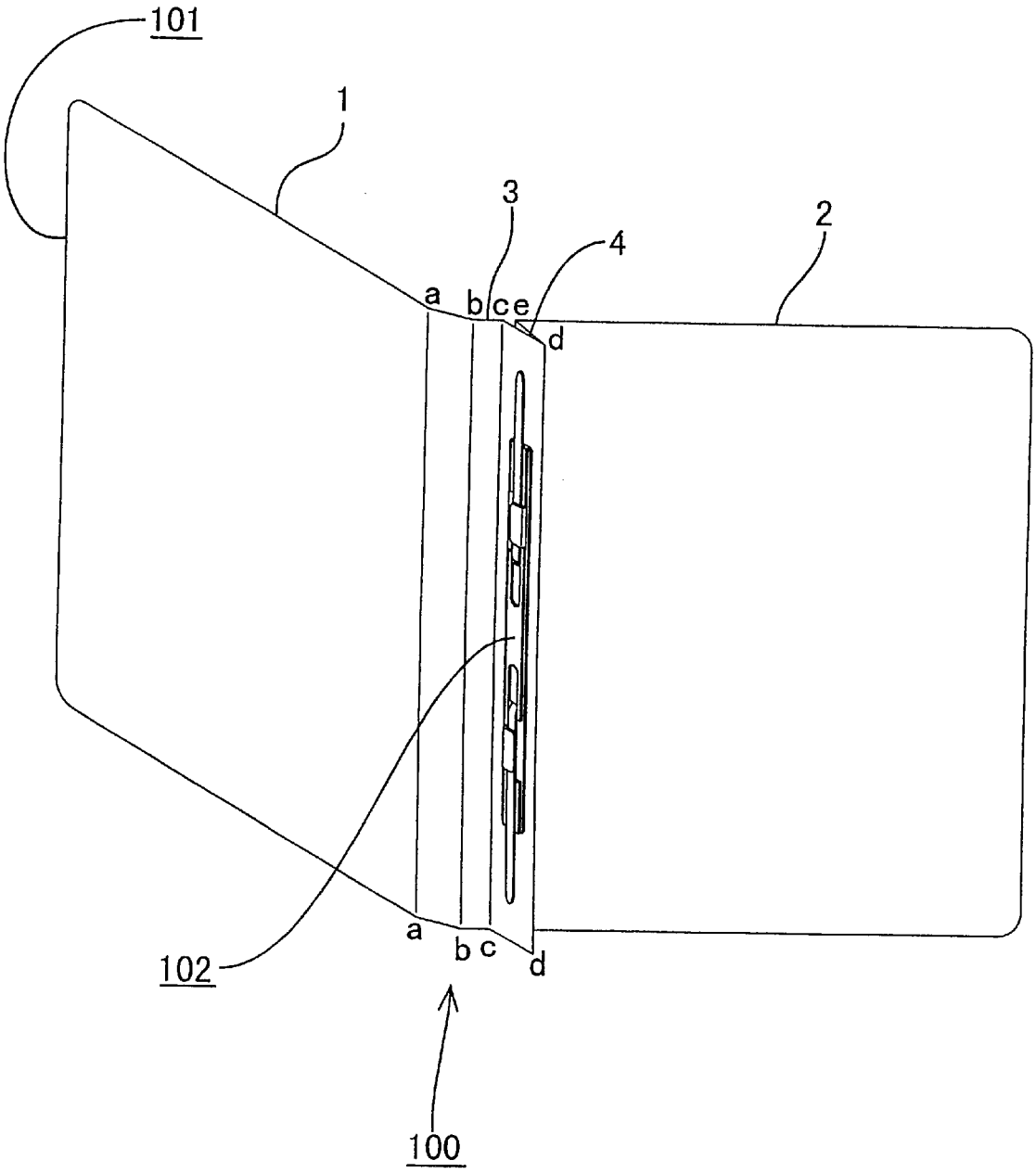
FIG. 16 is a perspective view of a conventional holder with a paper fastener.
Figure 17:
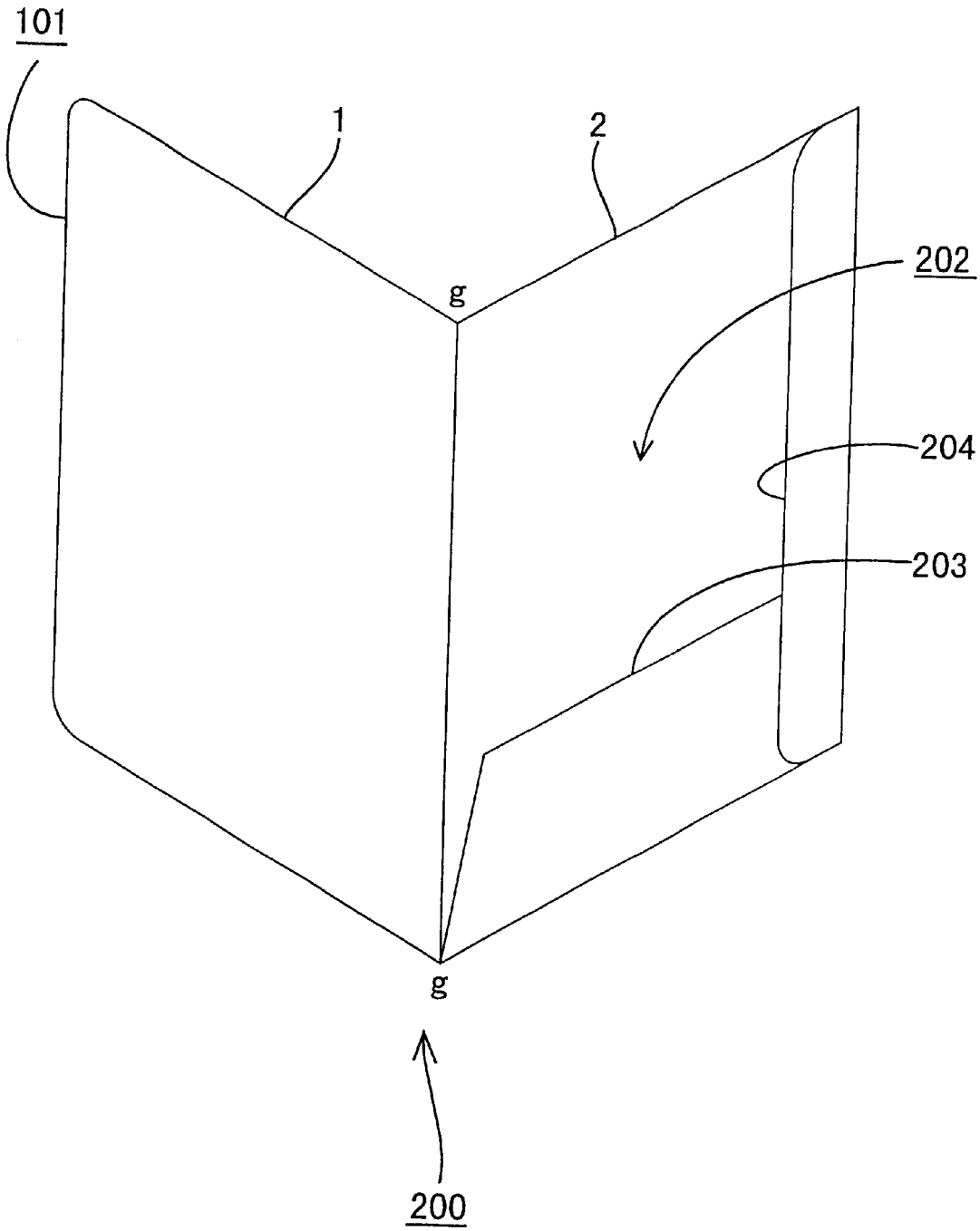
FIG. 17 is a perspective view of a conventional "pocket-type" holder.

A second embodiment of the present invention will be described with reference to FIGS. 4 and 5. In this embodiment, the holder cover is divided at the line d—d in the middle of the pleat 4 in FIG. 16. This kit for making a holder 20 of A4 size with a paper fastener 7 comprises three members 21, 22 and 23 as schematically shown in FIG. 4. The member 21 is a substantially flat paper sheet consisting of a front panel 1, a spine panel 3 and a front pleat 4*f* separated from other portions of the holder cover. Although two of the corners of the front panel 1 may be slightly rounded, the member 21 is in a generally rectangular form with its length following standardized lengthwise A4 length. On the member 21 are folding lines a—a, b—b, c—c and two apertures 4*fa* formed on the front pleat 4*f*. The member 22 is a paper sheet consisting of a back panel 2 and a back pleat 4*b* folded on its line e—e. On the member 22, two apertures 4*ba* are formed on the back pleat 4*b* and a double-coated adhesive tape 6 is adhesively bonded on its outside surface along side edge d'—d'. The third member 23 consists of a fastener 7 as a holding part for holding flat objects. The fastener 7 has the same structure as the one used in the first embodiment, which comprises two strips 13 and a bar 14. In this kit, the fastener 7 is provided separately from other members. The strips 13 are threaded through only apertures 14*a* on the bar 14 upon which the strips 13 are bent over and pushed under the engaging claw 14*c* on the bar 14 to attach the strips 13 to the bar 14.

Upon making an original holder 20 using the above-described kit, the member 21 is fed through a printer, and any desired designs are printed thereon. If desired, the member 22 can also be printed in the same manner. After printing, the members 21 and 22 are overlapped with their side edges d—d and d'—d' matching up and secured by the adhesive tape 6. The holder 20 assembled with this kit is shown in FIG. 5. Releasing the strips 13 from the engaging claw 14*c*, they are then separated each other. The strips 13 are fixed on the pleat 4, being threaded through aligned apertures 4*fa* and 4*ba* of the front and back pleat 4*f* and 4*b*. Then, apertured papers are threaded on to the strips 13 before the bar 14 is threaded onto them, and the strips 13 are flattened and pushed under the engaging claw 14*c* to hold all of them together.

According to the second embodiment, a kit is provided in which the holder cover is divided into two members 21 and 22. Since the length of the member 21 substantially follows lengthwise A4 length, it is much easier to directly print on it than on the front panel 1 of conventional holder 100. In this embodiment, the member 21 consists not only the front panel 1, but also the spine panel 3, making the member 21 wider than the standardized lengthwise A4 width. This structure prevents the holder cover from being printed by small printers in which the feeding width is limited within the lengthwise A4 width, whereas it makes it possible to print on the front panel 1 and the spine panel 3 at same time when bigger printers are used. In order to print directly on the member 21, the thickness of the sheet used as the member 21 is limited depending on the performance of the printer. However, a thicker sheet can be used for the member 22 to provide enough strength and rigidity to the holder 20 in case printing on the back panel 2 is not desired. The holder 20 can be assembled easily just by securing the member 21 to the member 22 with the double coated adhesive tape 6 on the member 22.

<Third Embodiment>

Figure 6:
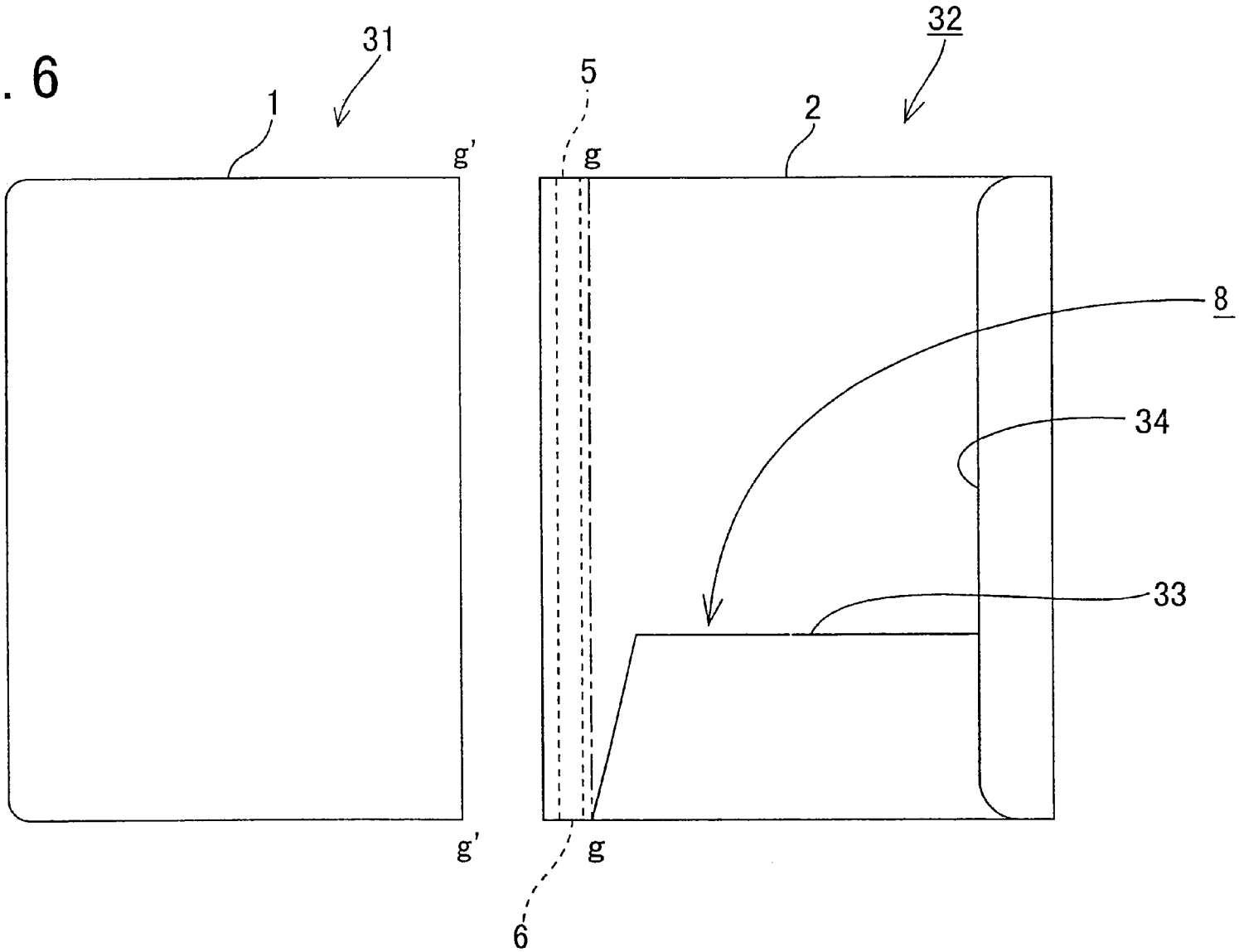
FIG. 6 is a plan view of a kit of a third embodiment in accordance with the present invention.
Figure 7:
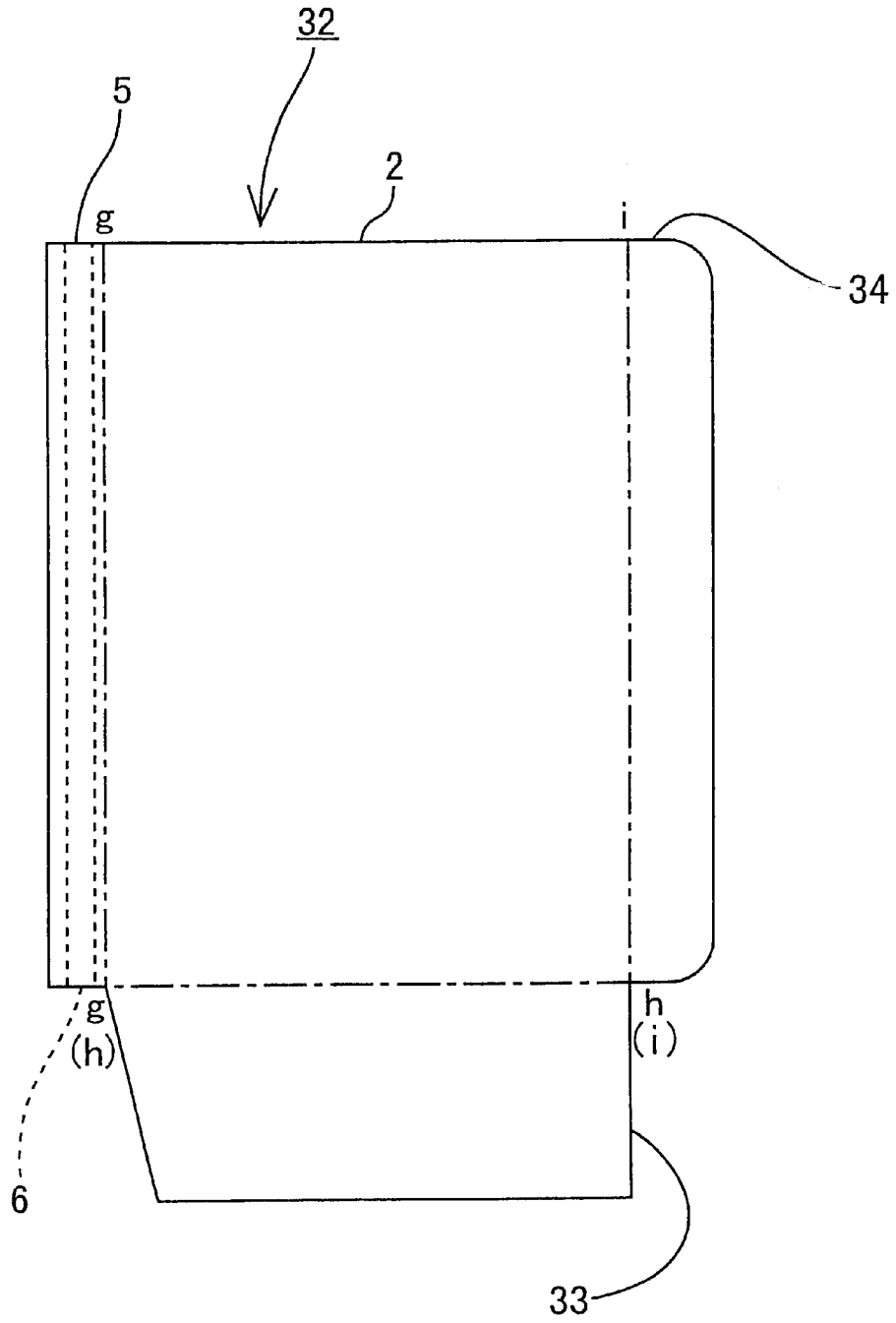
FIG. 7 is a plan view of a back cover member of the kit of the third embodiment.
Figure 8:
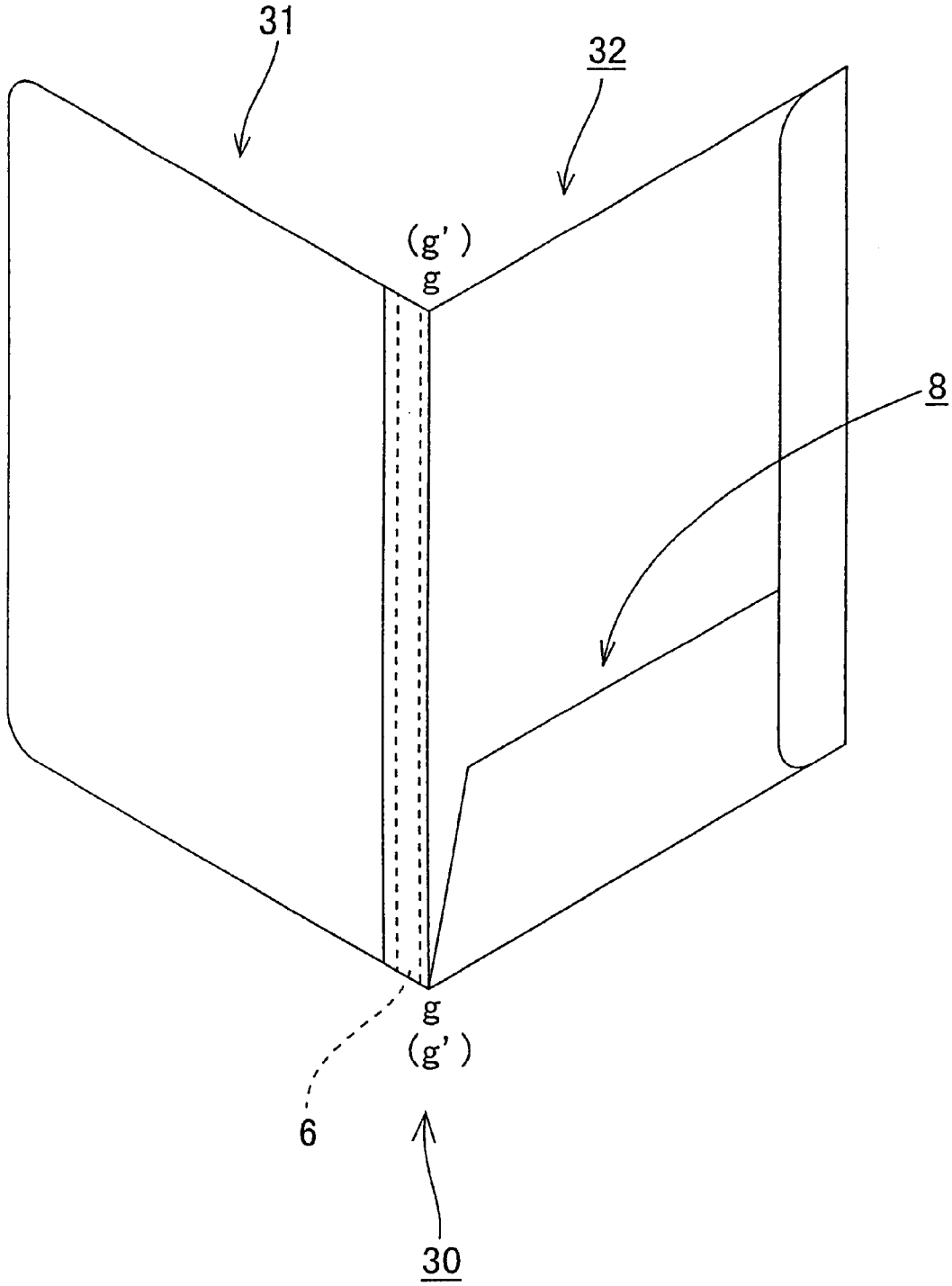
FIG. 8 is a perspective view of a document holder assembled with the kit of the third embodiment.

A third embodiment of the present invention will be described with reference to FIGS. 6 through 8. FIG. 6 schematically shows a kit for making an A4 size pocket-type holder 30. The kit comprises two members 31 and 32. The member 31 is a flat paper sheet consisting only of a front panel 1 isolated from other portions of the holder 30. Although two of its corners may be slightly rounded, the member 31 is generally rectangular with exactly standardized A4 width, whereas its length is slightly longer than standardized A4 length. The member 32 comprises the rest of the holder 30, having a pocket 8. FIG. 7 shows a developed plan view of the member 32. The member 32 is made with single paper sheet. The paper includes a generally rectangular joint portion 5, a generally trapezoidal pocket bottom flap 33 and a generally rectangular pocket side flap 34, extending from one side edge, the bottom, and the other side edge of a rectangular back panel 2, respectively. The joint portion 5, the pocket bottom flap 33 and the pocket side flap 34 are connected to the back panel 2 by folding lines g—g, h—h and i—i, respectively. In the kit, the pocket bottom flap 33 and the pocket side flap 34 are folded and glued to form a pocket 8 as a holding part for holding flat objects. Both the length and the width of the back panel 3 are slightly bigger than A4 size. A double-coated adhesive tape 6 is adhesively bonded on the outside surface of the joint portion 5 along the line g—g.

Upon making an original holder 30 using above-described kit, the member 31 is fed through a printer and any desired designs are printed thereon. After printing, the members 31 and 32 are overlapped with the edge g'—g' matching the folding line g—g, and are secured with the adhesive tape 6. The holder 30 assembled with this kit is shown in FIG. 8. This holder 30 can hold flat objects like documents, floppy disks etc. in its pocket 8.

According to the third embodiment, a kit is provided in which the holder 30 is divided into two members 31 and 32. Since the member 31 consisting of the front panel 1 has exactly the same width as that of A4 size, it is much easier to directly print on it than on the front panel 1 of the conventional holder 200. Furthermore, even small printers whose feeding width is limited to A4 width can be used in this printing operation. On the other hand, the back panel 2 is slightly wider than standardized lengthwise A4 size, the same as ordinary holders for holding A4 size documents, which causes a gap between the widths of the front and back panels to make opening the assembled holder 30 easier. In order to print directly on the member 31, the thickness of the sheet used as the member 31 is limited depending on the performance of the printer. However, a thicker sheet can be used for the member 32 to provide enough strength and rigidity to the holder 30. The holder 30 can be assembled easily just by securing the member 31 to the member 32 with the double coated adhesive tape 6 on the member 32.

<Fourth Embodiment>

Figure 9:
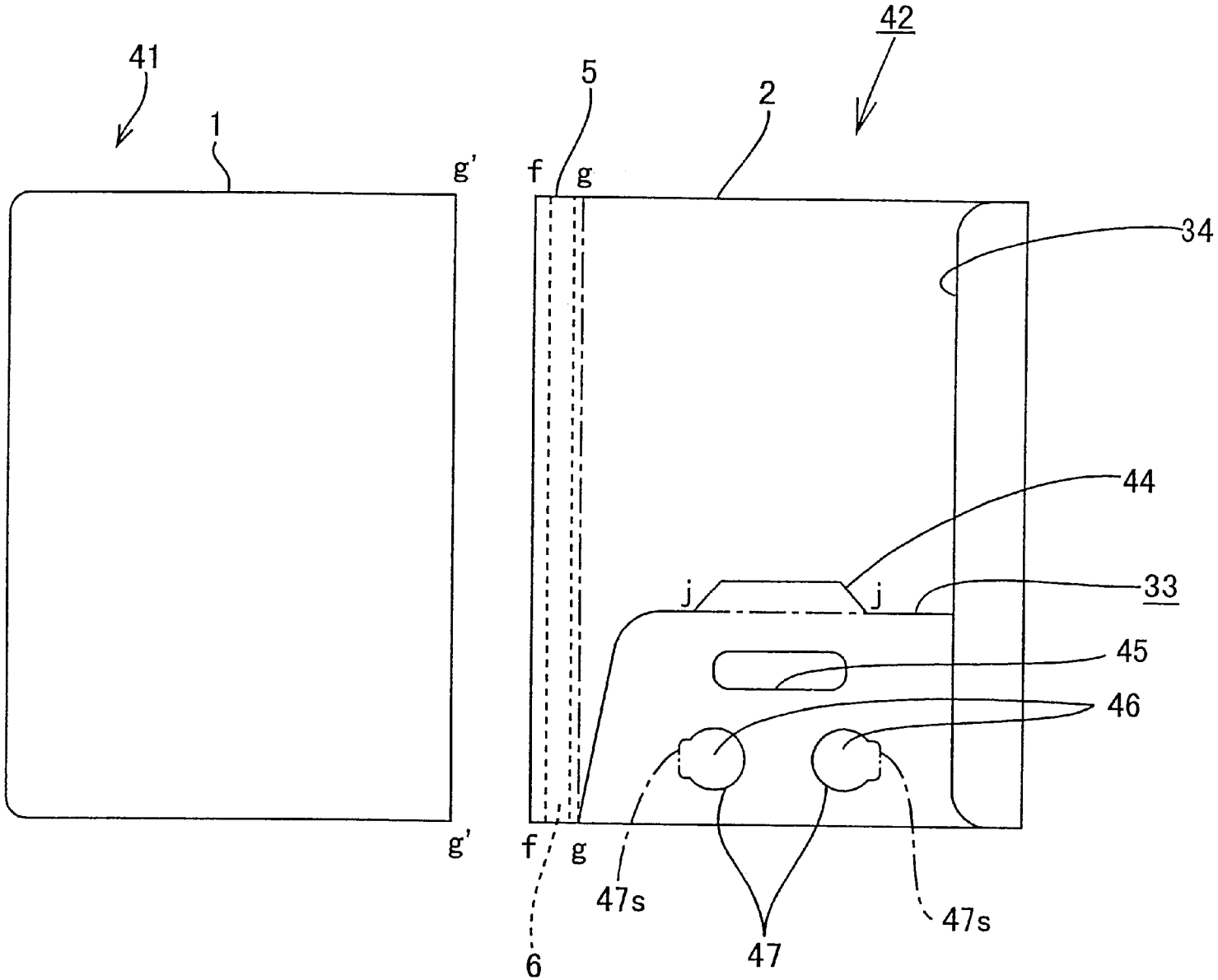
FIG. 9 is a plan view of a kit of a forth embodiment in accordance with the present invention.
Figure 10:
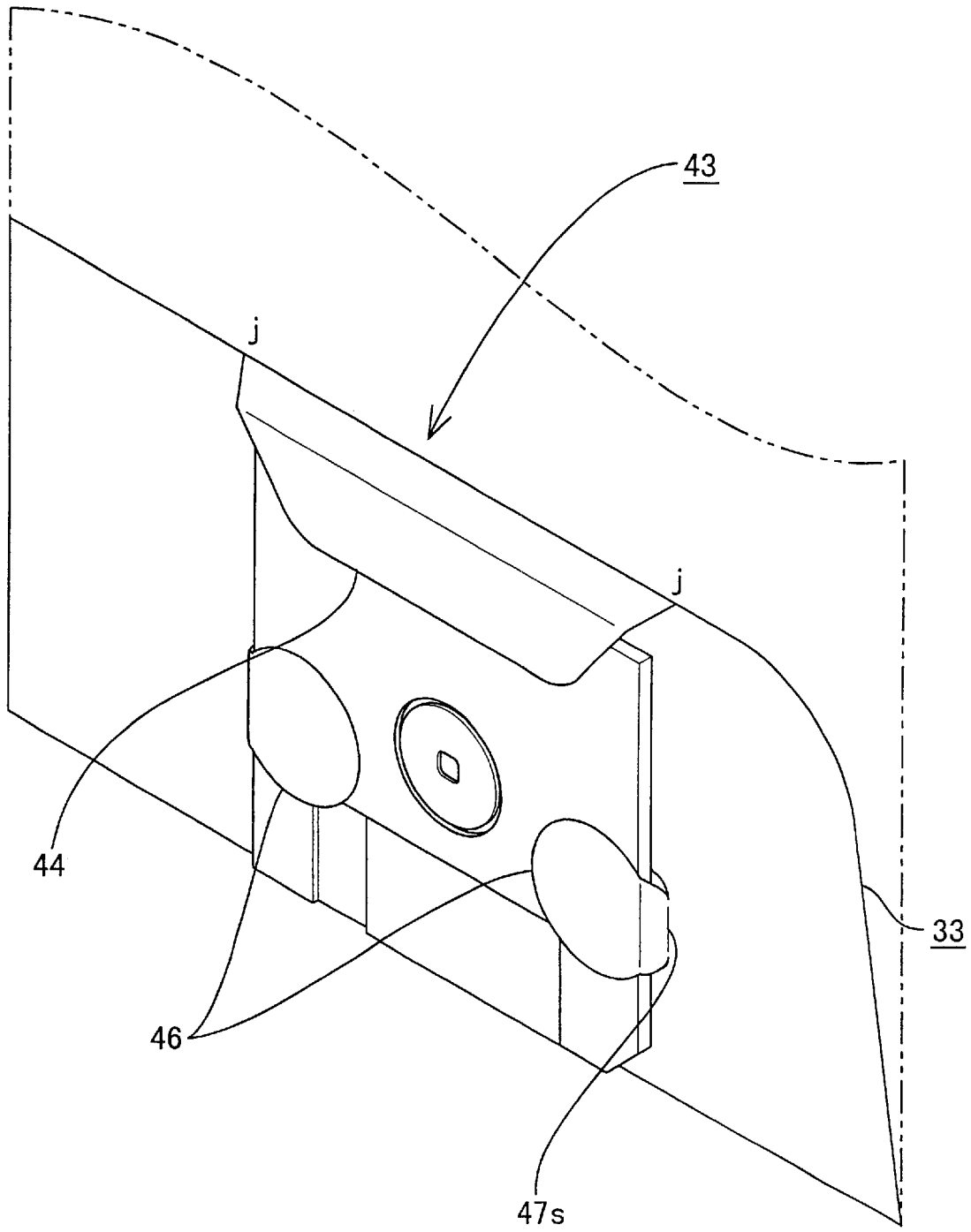
FIG. 10 is an enlarged perspective view showing a disk accommodating system formed inside of a document pocket.
Figure 11:
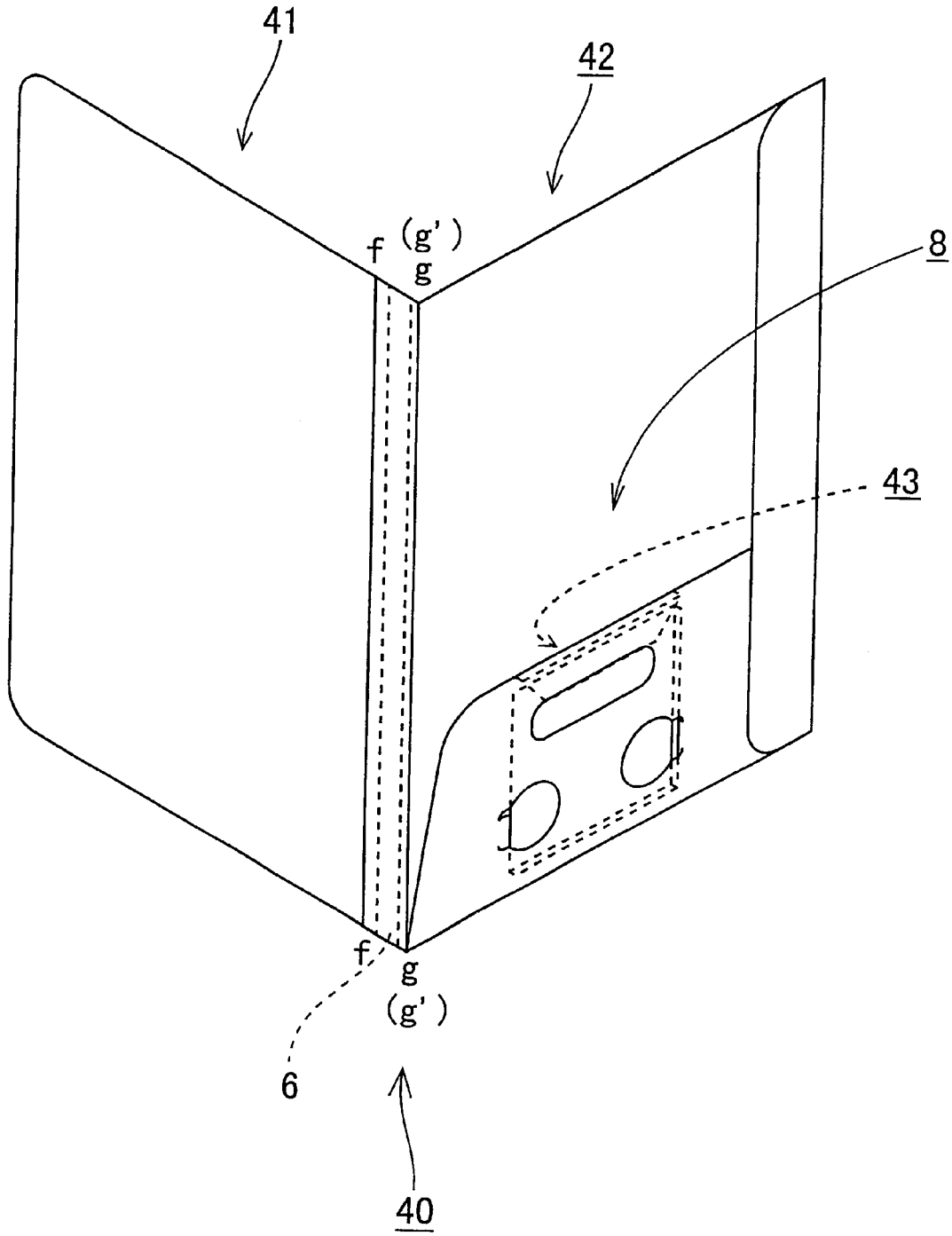
FIG. 11 is a perspective view of a document holder assembled with the kit of the forth embodiment.

A fourth embodiment of the present invention will be described with reference to FIGS. 9 through 11. The kit shown in FIG. 9 is intended to make a pocket-type holder 40 of A4 size especially designed to hold FD/MO together with documents. This kit comprises two members 41 and 42. The member 41 consists of a front panel 1, and the member 42 consists of a back panel 2, a joint portion 5 with a double-coated adhesive tape 6, a pocket bottom flap 33 and a pocket side flap 34. Both of these two members 41 and 42 have almost same structures as the members 31 and 32 described in the third embodiment, respectively. Distinctive features of this kit are in the pocket bottom flap 33. The pocket bottom flap 33 has a covering flap 44 and two disk holding claws 46 which together form a disk accommodating system 43 for FD/MO of a predetermined size inside of a pocket 8 for documents. The trapezoidal covering flap 44 extends from the pocket bottom flap 33. A folding line j—j is formed along the top edge of the pocket bottom flap 33 from which the covering flap 44 is extended. On the pocket bottom flap 33 below the folding line j—j is a generally rectangular through hole 45. The two disk holding claws 46 are located below the through hole 45. The disk holding claws 46 can be formed by cutting generally U-shaped notches 47 on the pocket bottom flap 33 oppositely to each other to face their respective curved portions. The distance between sidelines 47s of the two notches 47 are slightly longer than the width of the FD/MO.

Upon making an original holder 40 using above-described kit, the member 41 is fed through a printer and any desired designs are printed thereon. After printing, the members 41 and 42 are overlapped with the edge g'—g' matching the holding line g—g and secured by the adhesive tape 6. The holder 40 assembled with this kit is shown in FIG. 11. This holder 40 can hold relatively big flat objects like documents in its pocket 8 and an FD/MO of a predetermined size in the disk accommodating system 43. To hold the FD/MO in the disk accommodating system 43, the two notches 47 on the pocket bottom flap 33 are cut and two disk holding claws 46 are pushed inside the pocket 8. Then, the FD/MO is inserted between two disk holding claws 46 and the inside surface of the pocket bottom flap 33. After that, the covering flap 44 is folded on the folding line j—j to bend inside the pocket 8. The FD/MO is held in the disk accommodating system 43 formed inside of the pocket 8 as shown in FIG. 10.

According to the fourth embodiment, a kit is provided in which the holder 40 is divided into two members 41 and 42. Since the member 41 consisting of the front panel 1 has exactly the same width as that of A4 size, it is much easier to directly print on it than on the front panel 1 of the conventional holder 200. Furthermore, even a small printer whose feeding width is limited to A4 width can be used in this printing operation. On the other hand, the back panel 2 is slightly wider than standardized A4 size, the same as ordinary holders for holding A4 size documents, which causes a gap between the widths of the front and back panels to make opening the assembled holder 40 easier. In order to print directly on the member 41, the thickness of the sheet used as the member 41 is limited depending on the performance of the printer. However, a thicker sheet can be used for the member 42 to provide enough strength and rigidity to the holder 40. The holder 40 can be assembled easily just by securing the member 41 to the member 42 with the double coated adhesive tape 6 on the member 42.

Additionally, according to the fourth embodiment, documents and an FD/MO, which have different sizes and shapes, can be organized and held together in one holder 40. The disk accommodating system 43 in this embodiment can be simply formed with the extending portion and notches on the pocket bottom flap 33. Therefore, the disk accommodating system 43 can be formed only when it is desired and would not cause much increase in the cost. The FD/MO can be well fitted and held in the disk accommodating system 43 without any possibility of slipping off from the holder 40. The label of the FD/MO can be seen from the through hole 45.

<Fifth Embodiment>

Figure 12:
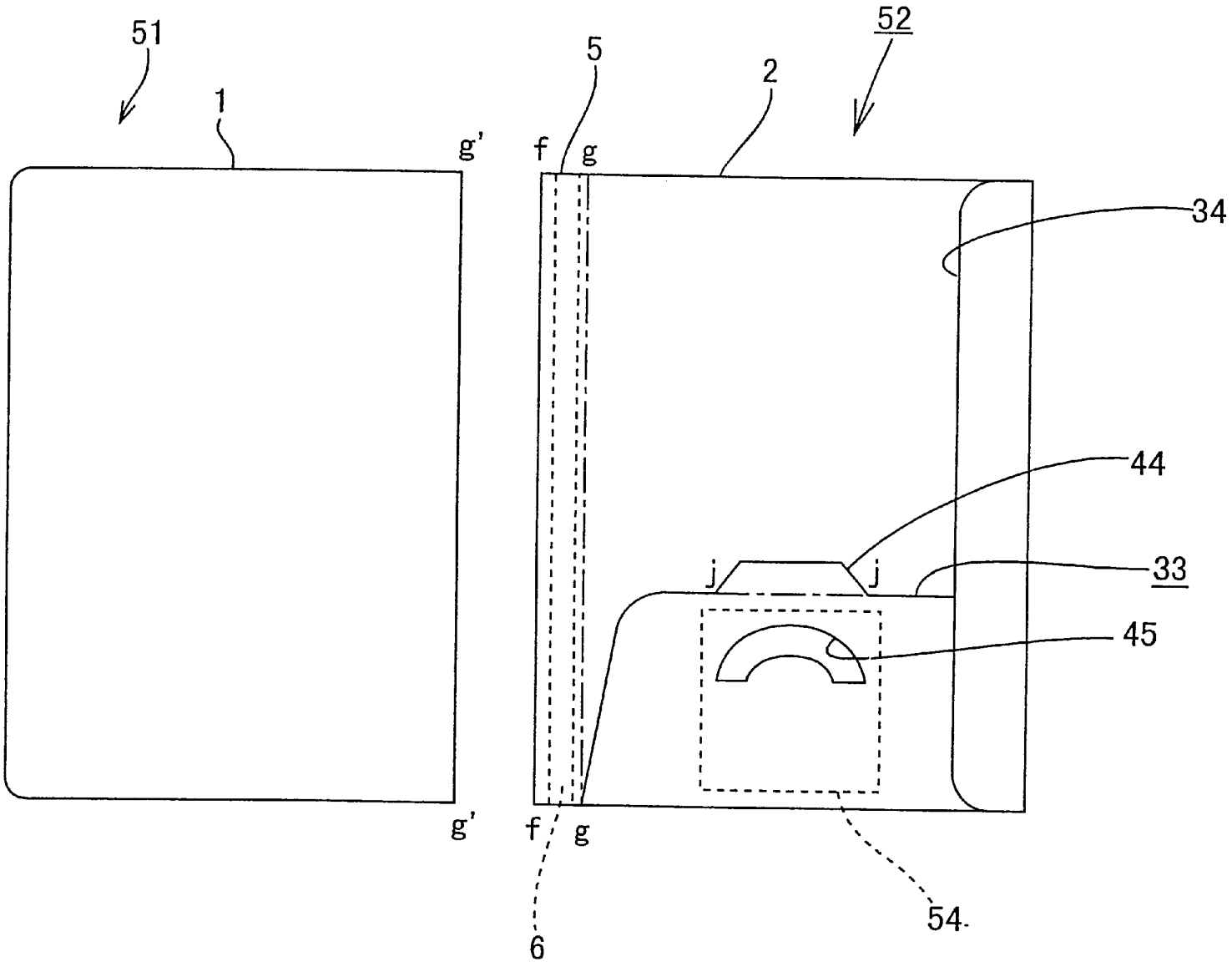
FIG. 12 is a plan view of a kit of a fifth embodiment in accordance with the present invention.
Figure 13:
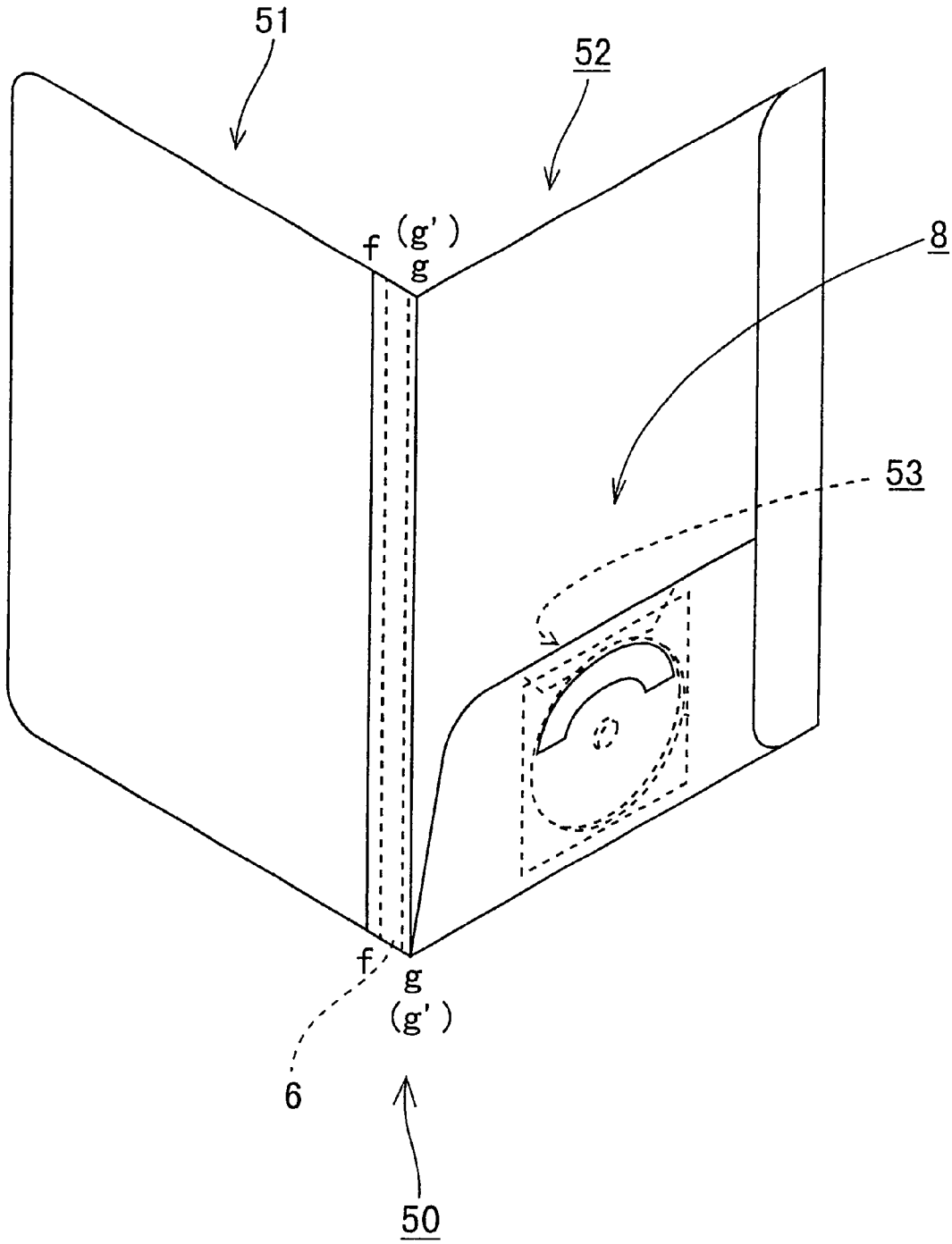
FIG. 13 is a perspective view of a document holder assembled with the kit of the fifth embodiment.

A fifth embodiment of the present invention will be described with reference to FIGS. 12 and 13. A kit shown in FIG. 12 is intended to make a pocket-type holder 50 of A4 size especially designed to hold a CD together with documents. This kit comprises two members 51 and 52. The member 51 consists of a front panel 1, and the member 52 consists of a back panel 2, a joint portion 5 with a double-coated adhesive tape 6, a pocket bottom flap 33 and a pocket side flap 34. Both of these two members 31 and 32 described in the third embodiment, respectively. Distinctive features of this kit are also in the pocket bottom flap 33. The pocket bottom flap 33 has a covering flap 44 and an inside pocket 54 which together form a disk accommodating system 53 for a CD of predetermined size. The trapezoidal covering flap 44 extends from the pocket bottom flap 33. A folding line j—j is formed along the top edge of the pocket bottom flap 33 from which the covering flap 44 is extended. The inside pocket 54 is attached to the inside surface of the pocket bottom flap 33 below the folding line j—j is a through hole 45 drawing an arc.

Upon making an original holder 50 using above-described kit, the member 51 is fed through a printer and any desired designs are printed thereon. Since the member 51 has exactly the same width as A4 size, it can be printed very easily. After printing, the members 51 and 52 are overlapped with the edge g'—g' matching the holding line g—g and are secured with the adhesive tape 6. The holder 50 assembled with this kit is shown in FIG. 13. This holder 50 can hold relatively big flat objects like documents in its pocket 8 and the CD of predetermined size in the disk accommodating system 53. To hold the CD in the disk accommodating system 53, the CD is inserted into the inside pocket 54 and the covering flap 44 is folded along the folding line j—j and bent inwardly of the pocket 8 to prevent the CD from slipping out.

According to the fifth embodiment, a kit is provided in which the holder 50 is divided into two members 51 and 52. Since the member 51 consisting of the front panel 1 has exactly the same width as A4 size, it is much easier to directly print on it than on the front panel 1 of the conventional holder 200. Furthermore, even a small printer whose feeding width is limited to A4 width can be used in this printing operation. On the other hand, the back panel 2 is slightly wider than standardized lengthwise A4 size, the same as ordinary holders for holding A4 size documents, which causes a gap between the widths of the front and back panels to make opening the assembled holder 50 easier. In order to print directly on the member 51, the thickness of the sheet used as the member 51 is limited, depending on the performance of the printer. However, a thicker sheet can be used for the member 52 to provide enough strength and rigidity to the holder 50. The holder 50 can be assembled easily just by securing the member 51 to the member 52 with the double coated adhesive tape 6 on the member 52.

Additionally, according to the fifth embodiment, documents and CDs, which have different sizes and shapes, can be organized and held together in one holder 50. According to this embodiment, the CD can be well fitted and held in the disk accommodating system 53 with the covering flap 44 without any possibility of slipping out from the holder 50. One face of the inside pocket 54 which holds the CD is preferably made with a sheet of nonwoven web which can protect the CD's recorded surface from being scuffed and scratched. The other face of the inside pocket 54 can be made with a transparent plastic film so that the label of the CD can be seen from the through hole 55.

It should be noted that the present invention is in no way limited to the details of the illustrated structures. It should be understood that minor changes may be made in the form and construction of the invention without departing from the material spirit thereof. For example, modifications described below can be made within the scope of this invention.

Figure 14:
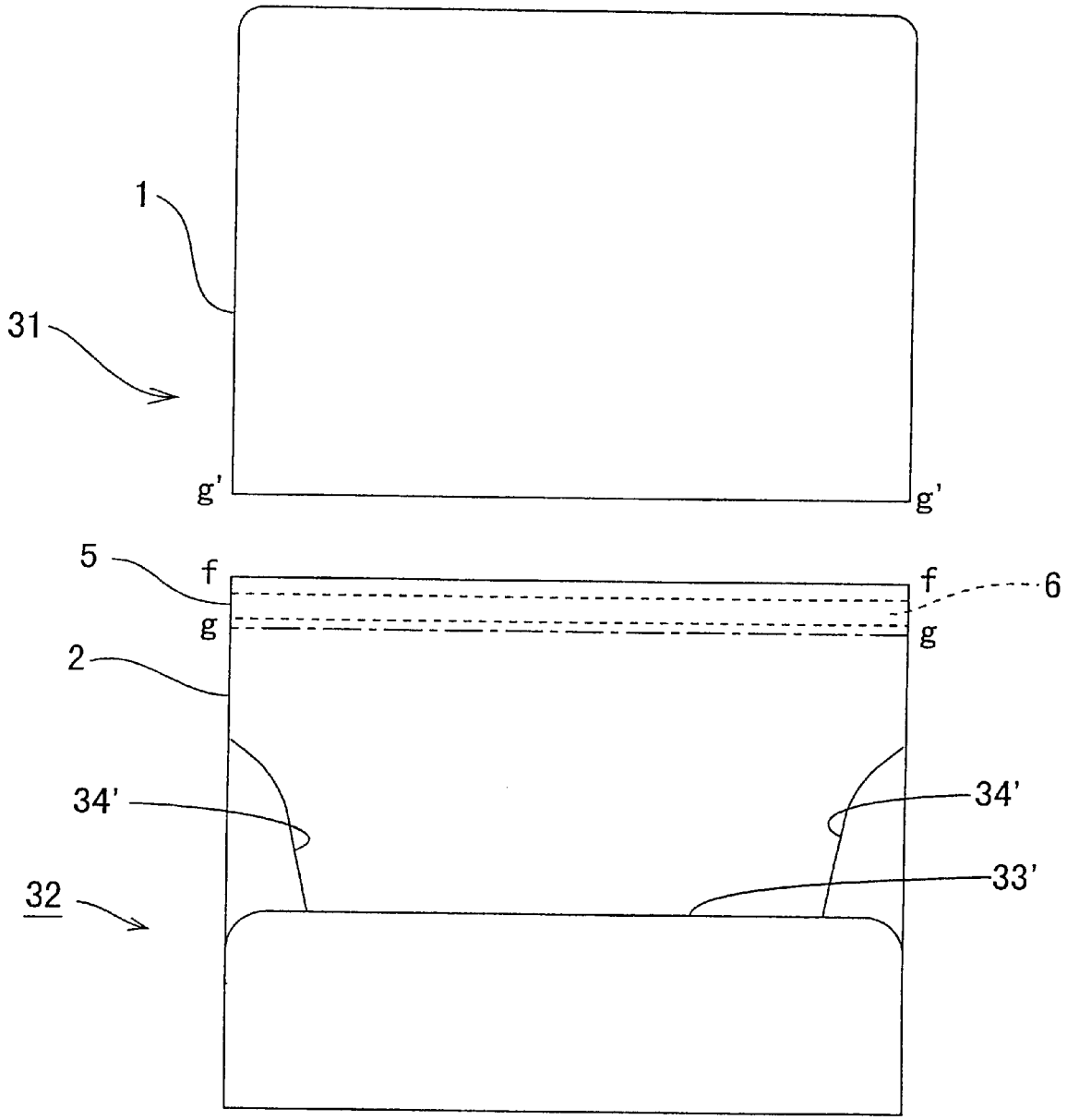
FIG. 14 is a plan view of a modified kit of the third embodiment for making a landscape type holder.

It is obvious that the size and direction of the holder assembled with the kit according to the present invention is not limited. For instance, in a modification of the third embodiment, two pocket side flaps 34' on the shorter edges of a back panel 2 and a pocket bottom flap 33' on one of the longer edge of a back panel 2 can be formed to provide an expansive holder as shown in FIG. 14.

The holder for holding flat objects is not limited to paper fasteners and pockets. Rings, tubes and clips, etc., with various structures, can be used. For instance, in the third embodiment, the pocket can further have clips or covering flaps to prevent the held documents from slipping out.

The holder cover can be divided into three or more members depending on the sizes of the holder and the printer, depending on desired assembly and use and the printing operation. For instance, the cover of a flat-type holder can be divided into three members including a front, a spine, and a back panel.

The joint for securing the members that together comprise the holder cover is not limited to the double-coated adhesive tape. Plastic and/or metal fasteners can be used as a joint. For example, in the second embodiment, the members 21 and 22 can be secured with the fastener 7 without the double-coated adhesive tape 6. Notches can be formed on one of the members to accept other members.

Sheets comprising the holder cover are not limited to paper. For example, the sheets intended to be printed thereon can be flexible plastic sheets, as long as they are printable. The sheets not intended to be printed thereon can be selected from a variety of materials such as hard plastic sheets, thick pasteboards covered with a face fabric, etc.

Figure 15:
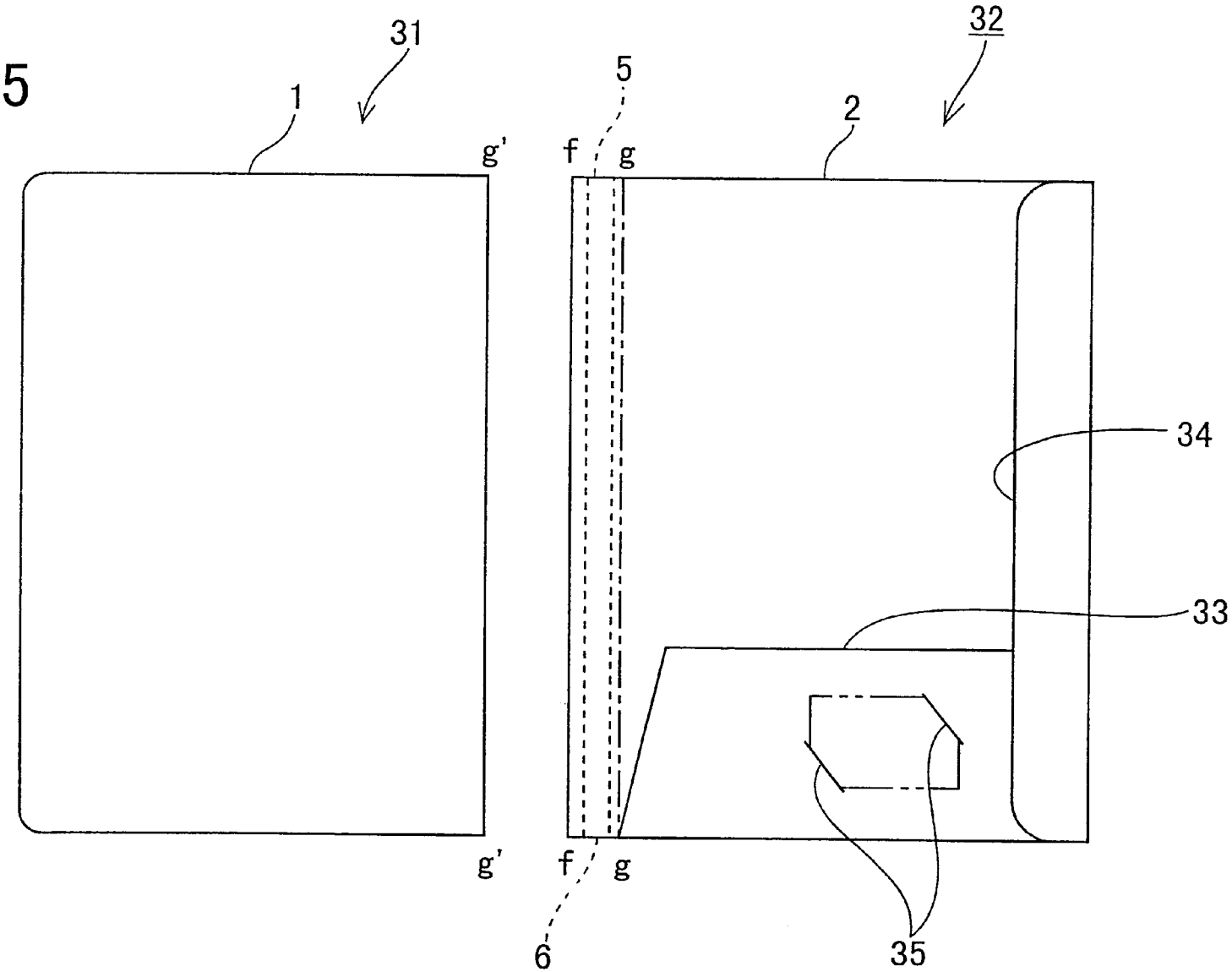
FIG. 15 is a perspective view of a document holder assembled from the modified kit of the third embodiment to display a name card in front of the document pocket.

The kit according to the present invention can also be designed to make holders that can hold various flat objects, including cassette tapes, slides etc. Furthermore, the holder can be made to display a name card on its pocket bottom flap 33 as shown in FIG. 15. In the kit to make the holder of this type, notches 35 are formed in the pocket bottom flap 33. This type of holder is very useful since the name and contact number of the person who is in charge of the held documents can be known quickly when utilizing them.

In the kit according to the present invention, instructions for their use, etc. may be printed on any surface of the members.

The kit according to the present invention can be designed to make holders used as a pocket page of a ring binder. For example, in the third embodiment, the members 31 and 32 may be perforated with holes along the lines g—g and g'—g' to receive the rings of a ring binder.

It is obvious that minor changes may be made in the form and construction of the invention without departing from the material spirit thereof. It is not, however, desired to confine the invention to the exact form herein shown and described, but it is desired to include all such as properly come within the scope claimed.

What is claimed is:

1. A kit for making a holder, comprising:

a plurality of members for forming a cover having a front panel and a back panel, said plurality of members including a first member defining said front panel;

a holding part for holding flat objects;

a connector part for connecting said plurality of members together, and thus for connecting said front panel and said back panel together;

wherein said first member comprises a substantially flat printable single sheet of generally rectangular form;

wherein at least one of length and width of said single sheet is the same as a standard paper size;

wherein said holding part comprises a fastener, said holding part being fixed on one of said plurality of members not including said first member; and wherein said first member defines both said front panel and a spine panel.

2. A kit for making a holder, comprising:

a plurality of members for forming a cover having a front panel and a back panel, said plurality of members including a first member defining said front panel; and a holding part for holding flat objects;

wherein said first member comprises a substantially flat printable single sheet of generally rectangular form; and wherein at least one of length and width of said single sheet is the same as a standard paper size;

wherein said first member defines said front panel and a spine panel; and wherein said first member further comprises a front pleat having two holes therein, said plurality of members includes a second member defining said back panel, said second member having a back pleat having two holes therein, and said holding part comprises a bar and two strips for insertion into said holes of said front pleat and said back pleat.

3. A kit for making a holder, comprising:

a plurality of members for forming a cover having a front panel and a back panel, said plurality of members including a first member defining said front panel; and a holding part for holding flat objects;

wherein said first member comprises a substantially flat printable single sheet of generally rectangular form; and wherein at least one of length and width of said single sheet is the same as a standard paper size;

wherein at least one of said plurality of members comprises a single sheet having a plurality of flaps for forming a pocket thereon; and wherein one of said plurality of flaps of said at least one of said plurality of members comprises a covering flap extending from a free side thereof, a hole extending there through and disk holding claws formed by notches therein for forming a disk holder.

4. A kit for making a holder, comprising:

a plurality of members for forming a cover having a front panel and a back panel, said plurality of members including a first member defining said front panel; and a holding part for holding flat objects;

wherein said first member comprises a substantially flat printable single sheet of generally rectangular form; and wherein at least one of length and width of said single sheet is the same as a standard paper size;

wherein at least one of said plurality of members comprises a single sheet having a plurality of flaps for forming a pocket thereon; and wherein one of said plurality of flaps of said at least one of said plurality of members comprises a covering flap extending from a free side thereof, a hole extending there through and an inside pocket for forming a disk holder.

5. A holder, comprising:

a plurality of members forming a cover having a front panel and a back panel, said plurality of members including a first member defining said front panel;

a holding part for holding flat objects; and a connector part connecting said plurality of members together, and thus connecting said front panel and said back panel together;

wherein said first member comprises a substantially flat printable single sheet of generally rectangular form;

wherein at least one of length and width of said single sheet is the same as a standard paper size;

wherein said holding part comprises a fastener, said holding part being fixed on one of said plurality of members not including said first member; and wherein said first member defines both said front panel and a spine panel.

6. A holder, comprising:

a plurality of members forming a cover having a front panel and a back panel, said plurality of members including a first member defining said front panel; and a holding part for holding flat objects;

wherein said first member comprises a substantially flat printable single sheet of generally rectangular form; and wherein at least one of length and width of said single sheet is the same as a standard paper size;

wherein said first member defines said front panel and a spine panel; and wherein said first member further comprises a front pleat having two holes therein, said plurality of members includes a second member defining said back panel, said second member having a back pleat having two holes therein, and said holding part comprises a bar and two strips inserted into said holes of said front pleat and said back pleat.

7. A holder, comprising:

a plurality of members forming a cover having a front panel and a back panel, said plurality of members including a first member defining said front panel; and a holding part for holding flat objects;

wherein said first member comprises a substantially flat printable single sheet of generally rectangular form; and wherein at least one of length and width of said single sheet is the same as a standard paper size;

wherein at least one of said plurality of members comprises a single sheet having a plurality of flaps forming a pocket thereon; and wherein one of said plurality of flaps of said at least one of said plurality of members comprises a covering flap extending from a free side thereof, a hole extending there through and disk holding claws formed by notches therein, said covering flap and disk holding claws forming a disk holder.

8. A holder, comprising:

a plurality of members forming a cover having a front panel and a back panel, said plurality of members including a first member defining said front panel; and a holding part for holding flat objects;

wherein said first member comprises a substantially flat printable single sheet of generally rectangular form; and wherein at least one of length and width of said single sheet is the same as a standard paper size;

wherein at least one of said plurality of members comprises a single sheet having a plurality of flaps forming a pocket thereon; and wherein one of said plurality of flaps of said at least one of said plurality of members comprises a covering flap extending from a free side thereof, a hole extending there through and an inside pocket forming a disk holder.

* * * * *